US010569598B1

(12) United States Patent
Getchell

(10) Patent No.: US 10,569,598 B1
(45) Date of Patent: Feb. 25, 2020

(54) PAINT BRUSH AND ROLLER HANDLE COUPLER

(71) Applicant: Garth Getchell, Mammoth Lakes, CA (US)

(72) Inventor: Garth Getchell, Mammoth Lakes, CA (US)

( * ) Notice: Subject to any disclaimer, the term of this patent is extended or adjusted under 35 U.S.C. 154(b) by 236 days.

(21) Appl. No.: 15/246,913

(22) Filed: Aug. 25, 2016

(51) Int. Cl.
*B44D 3/12* (2006.01)
*B25G 3/36* (2006.01)
*B25G 1/04* (2006.01)

(52) U.S. Cl.
CPC ..... *B44D 3/123* (2013.01); *B25G 1/04* (2013.01); *B25G 3/36* (2013.01)

(58) Field of Classification Search
CPC ..... A46B 7/04; A46B 7/046; A46B 7/048; A46B 5/0095; A46B 17/02; A46B 2200/202; A46B 17/00; B05C 17/0205; B05C 17/022; B25G 3/00; B25G 3/12; B25G 1/06
USPC .... 15/176.3, 146, 145, 144.4, 144.3, 230.11, 15/176.6, 176.1, 176.2
See application file for complete search history.

(56) References Cited

U.S. PATENT DOCUMENTS 3,981,595 A * 9/1976 Blake ..... A46B 11/0024 401/48
4,074,899 A * 2/1978 Hochstetler ..... B23P 11/00 269/249
4,541,139 A * 9/1985 Jones ..... B25G 3/22 15/145
5,991,956 A * 11/1999 Chapman ..... A46B 17/02 15/145
8,566,999 B1 * 10/2013 Casey ..... A46B 5/0083 15/146
9,237,799 B1 * 1/2016 Manning, Jr. ..... A46B 17/02
9,463,554 B2 * 10/2016 Blake, III ..... B25B 5/163

FOREIGN PATENT DOCUMENTS

GB 651683 A * 4/1951 ..... A46B 5/02

OTHER PUBLICATIONS

Home Depot, Wooswter 9 in. Sherlock Roller Frame, Aug. 17, 2012.*
Home depot, Wooster 9in. Sherlock Roller Frame, Aug. 17, 2012 https://www.homedepot.com/p/Wooser-9-in-Sherlock-Roller-Frame-00R0170090/100357410 (Year: 2012).*

* cited by examiner

*Primary Examiner* — Monica S Carter
*Assistant Examiner* — Abbie E Quann
(74) *Attorney, Agent, or Firm* — Shifrin Patent Law; Dan Shifrin

(57) ABSTRACT

A paint brush and roller handle coupler is provided, comprising a horizontal tubular upper section, a cylindrical section extending downward at an angle from the upper section, a first mechanism configured to secure a paint brush handle in the tubular upper section, and a second mechanism configured to secure a paint roller handle in the tubular upper section. The horizontal tubular upper section comprises an open front section, comprising a front edge having a first pair of notches spaced 180 degrees apart, and an open rear section.

13 Claims, 12 Drawing Sheets

PAINT BRUSH AND ROLLER HANDLE COUPLER

RELATED APPLICATION DATA

The present application is related to commonly-assigned and co-pending U.S. application Ser. No. 15/246,891 titled PAINT ROLLER FRAME, and U.S. application Ser. No. 29/575,473, titled PAINT BRUSH AND ROLLER HANDLE GRIP, both filed on Aug. 25, 2016, which applications are incorporated herein by reference in their entireties. The present application is also related to commonly-assigned and co-pending U.S. application Ser. No. 29/581,943 titled PAINT ROLLER FRAME, filed on Oct. 24, 2016, which application is incorporated herein by reference in its entirety.

TECHNICAL FIELD

The present invention relates generally to painting and, in particular, to a coupler for holding paint brushes and rollers and for attaching to the ends of a variety of poles.

BACKGROUND ART

Painting has traditionally been performed by the painter holding the handle of a paint brush or roller. For hard to reach locations, a roller handle may be threaded onto the end of a pole, whether fixed-length or telescoping. While effective, holding a conventional brush or roller handle for extensive periods of time, and over a number of years in the case of a professional painter, can be fatiguing and may cause certain physical problems, such as tendonitis, carpal tunnel syndrome, arthritis, and general fatigue.

SUMMARY OF THE INVENTION

Embodiments of the present invention provide a paint brush and roller handle coupler, comprising a horizontal tubular upper section, a cylindrical section extending downward at an angle from the upper section, a first mechanism configured to secure a paint brush handle in the tubular upper section, and a second mechanism configured to secure a paint roller handle in the tubular upper section. The horizontal tubular upper section comprises an open front section, comprising a front edge having a first pair of notches spaced 180 degrees apart, and an open rear section.

Embodiments also provide a roller handle coupler, comprising first and second horizontal tubular side sections, each comprising an open front section having a plurality of connected flat surfaces surrounding an interior space of the front section extending rearward from a front edge, and a latching mechanism configured to releasably secure a paint roller handle within the side section. The roller handle couple also comprises a cylindrical central section secured between the first and second side sections and extending upward at an angle from the side sections, the cylindrical section having an open upper end with a threaded interior wall.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Embodiments of the present invention provide a coupler to hold the handles of various types of painting tools, such as paint brush handles, roller handles, or both. The coupler also may also be removably secured to the ends of various types of extension poles.

Figure 1A:
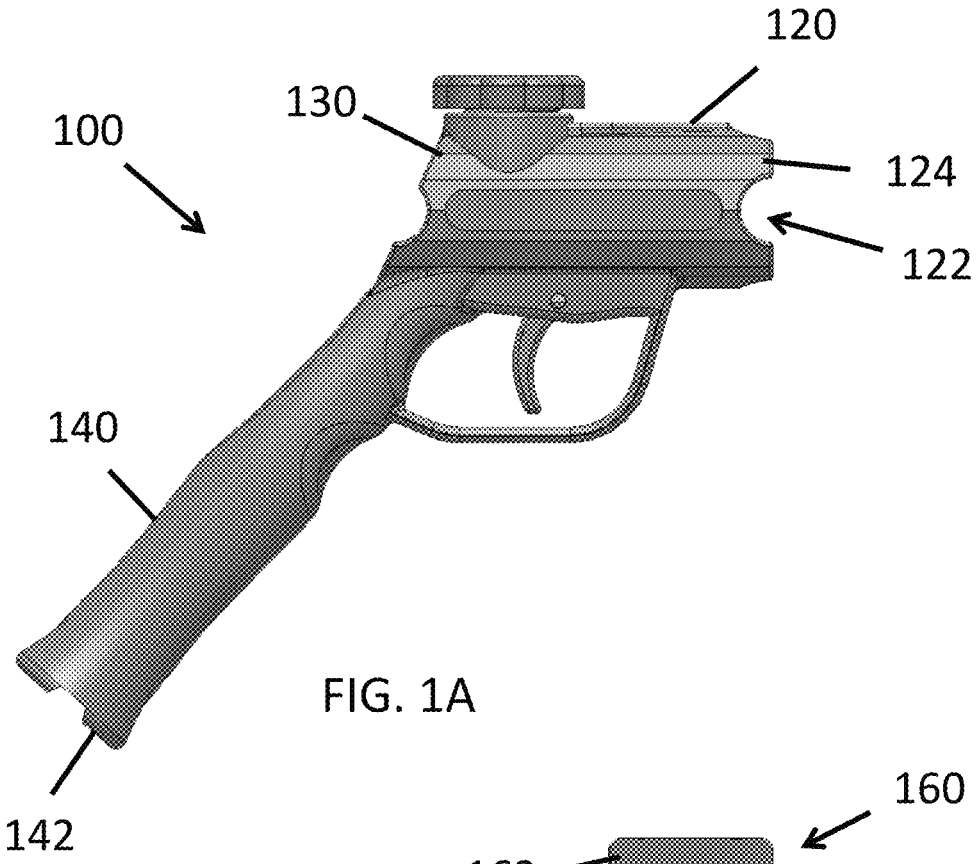
FIG. 1A illustrates a side view of an embodiment of a paint brush and roller coupler of the present invention.
Figure 1B:
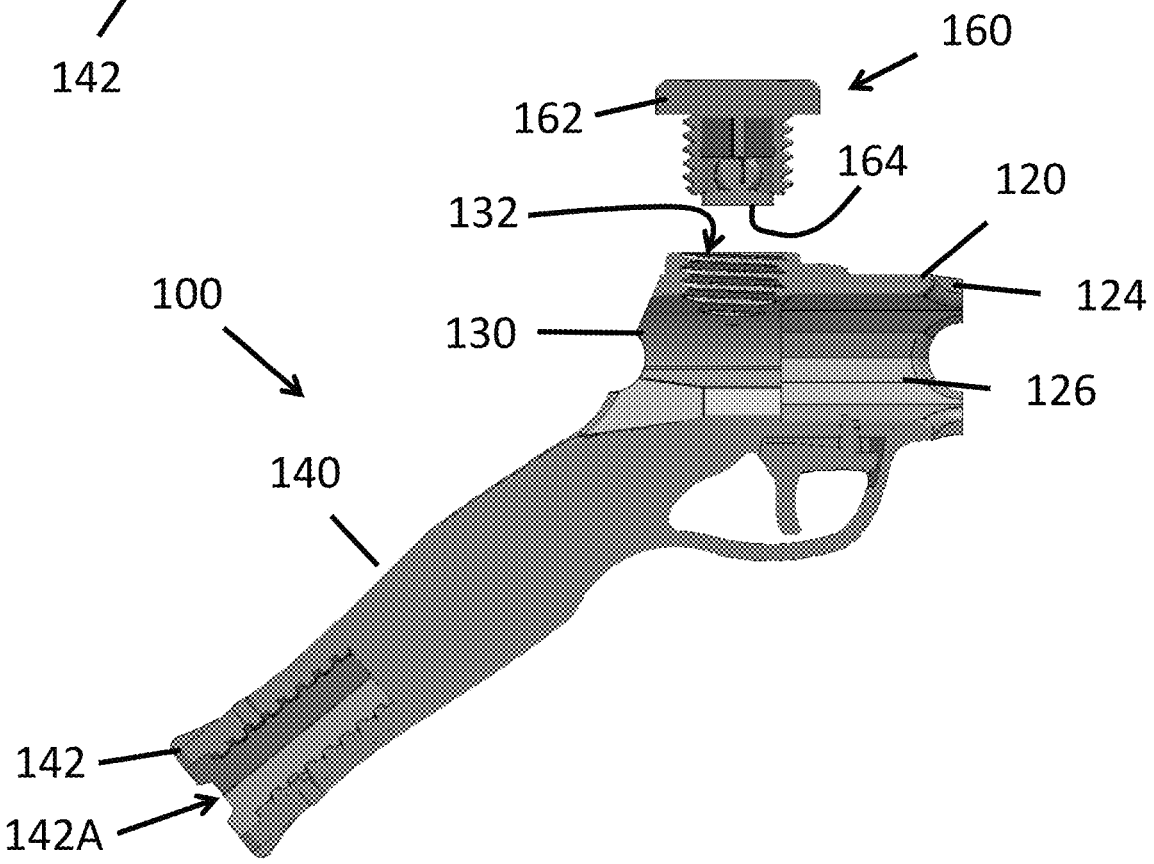
FIG. 1B illustrates a side cut-away view of the coupler of FIG. 1A.

FIGS. 1A, 1B, 1C, and 1D illustrate side, side cut-away, front perspective, and rear views, respectively, of an embodiment of a coupler 100 of the present invention. The coupler 100 includes a horizontal tubular upper section 120 and a cylindrical section 140 extending downward at an angle, such as about 45°, from the upper section 120. The upper section 120 has an open front section 122 that with a front edge 124 (best seen in FIG. 1C) and multi-sided interior walls 126 (best seen in FIG. 1B). The upper section 120 also has an open rear section 130. The cylindrical section 140 may include an open bottom end 142 (FIG. 1B). It will be appreciated that the exact angle of the cylindrical section 140 relative to the upper section 120 is not critical. An angle of approximately 45° provides a comfortable and ergonomic gripping position for the painter but other angles may also be used.

Figure 1C:
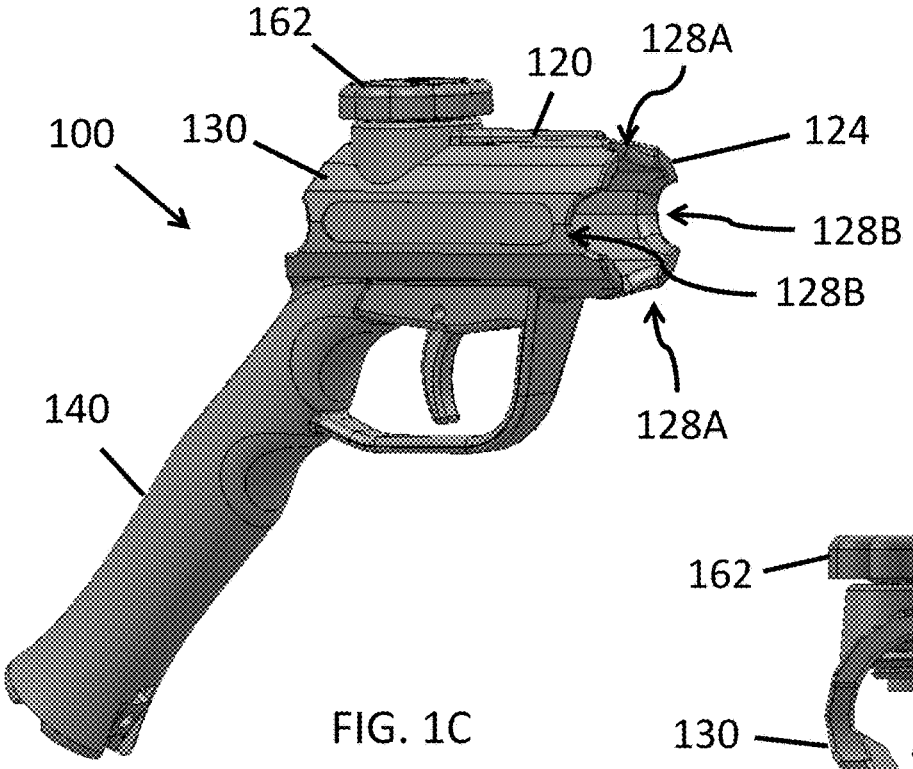
FIG. 1C illustrates a front perspective view of the coupler of FIG. 1A.
Figure 1D:
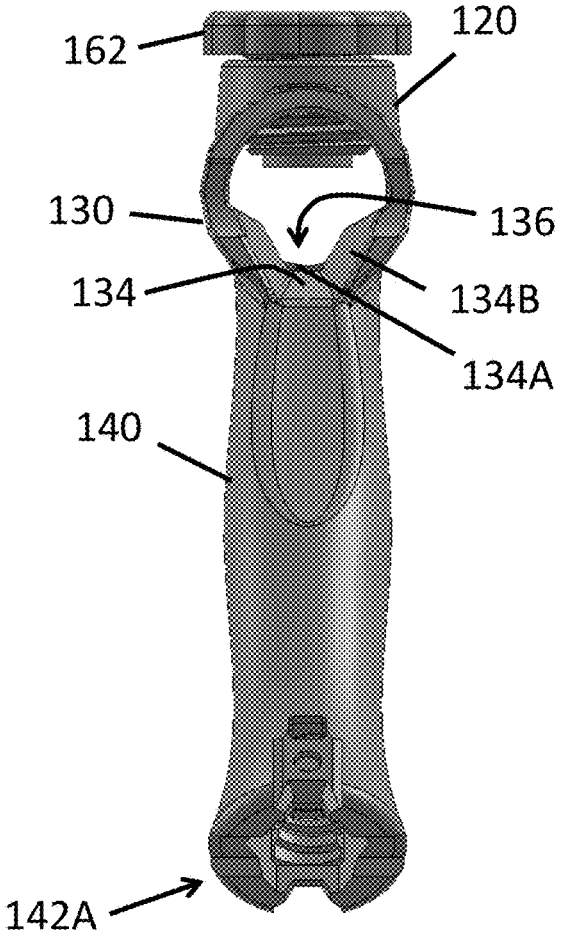
FIG. 1D illustrates a rear view of the coupler of FIG. 1A.
Figure 2A:
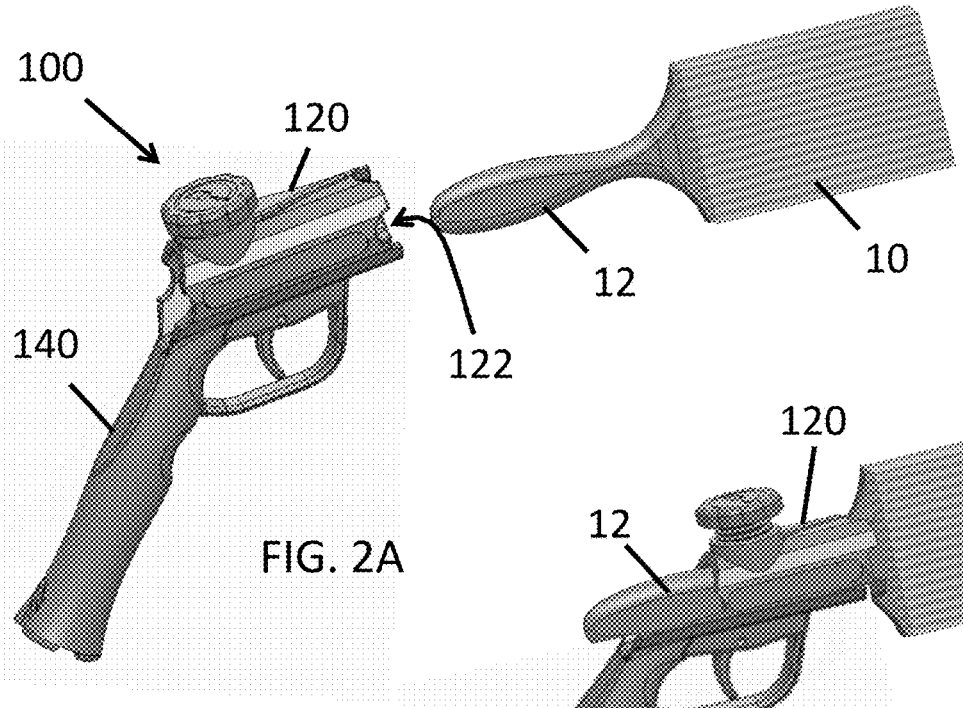
FIG. 2A illustrates a conventional paint brush before it is inserted into the coupler of FIG. 1A.
Figure 2B:
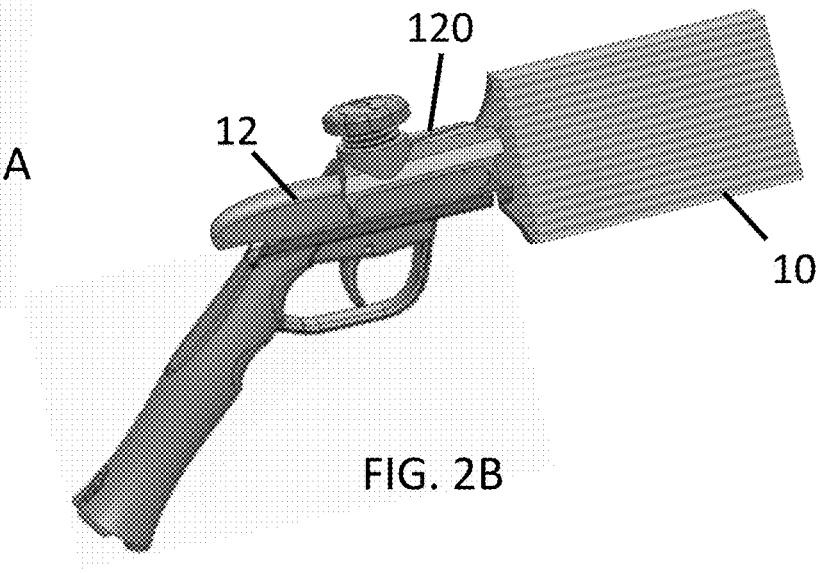
FIG. 2B illustrates the paint brush of FIG. 2A after it has been inserted into the coupler of FIG. 1A in a vertical orientation.
Figure 2C:
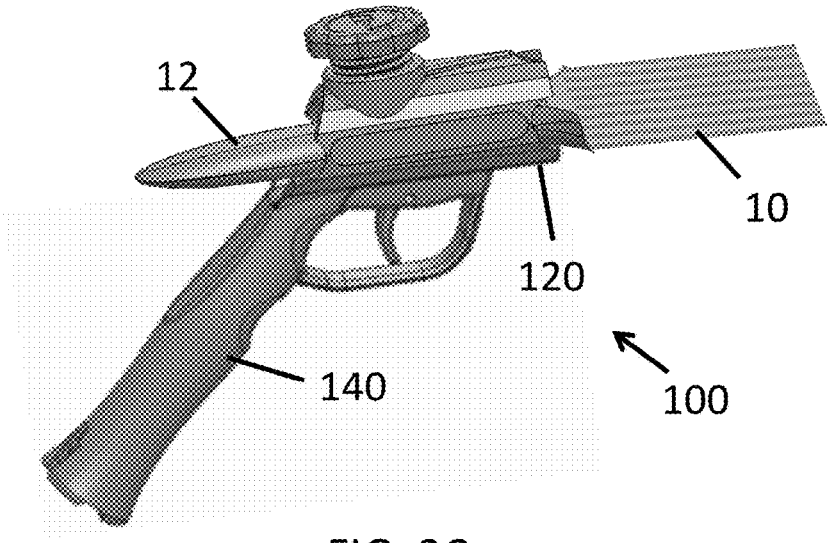
FIG. 2C illustrates the paint brush of FIG. 2A after it has been inserted into the coupler of FIG. 1A in a horizontal orientation.

The front edge 124 of the front section 122 may include one or two pairs of notches (collectively 128, best seen in FIG. 1C). One pair of notches 128A may be spaced about 180° apart in the top and bottom of the front edge 124. The other pair of notches 128B may be spaced about 180° apart in opposing sides of the front edge 124. Thus, the notches 128 are spaced approximately 90° apart around the front edge 124. In some embodiments, the front edge 124 has only one pair of notches 128A or 128B while in other embodiments, the front edge 124 has both pairs of notches 128A and 128B. When the front edge 124 is formed with both pairs of notches 128A and 128B, the handle 12 of a brush 10 to be inserted into the open front section 122 with the back edge of the wide base (FIG. 2A) fitting within either pair of notches 128A or 128B, depending on whether the brush bristles are to be in the vertical position (notches 128A; FIG. 2B) or horizontal position (notches 128B; FIG. 2C). In the event that the front edge 124 is formed with only a single pair of notches 128A or 128B, the position of the bristles will be fixed.

Figure 3A:
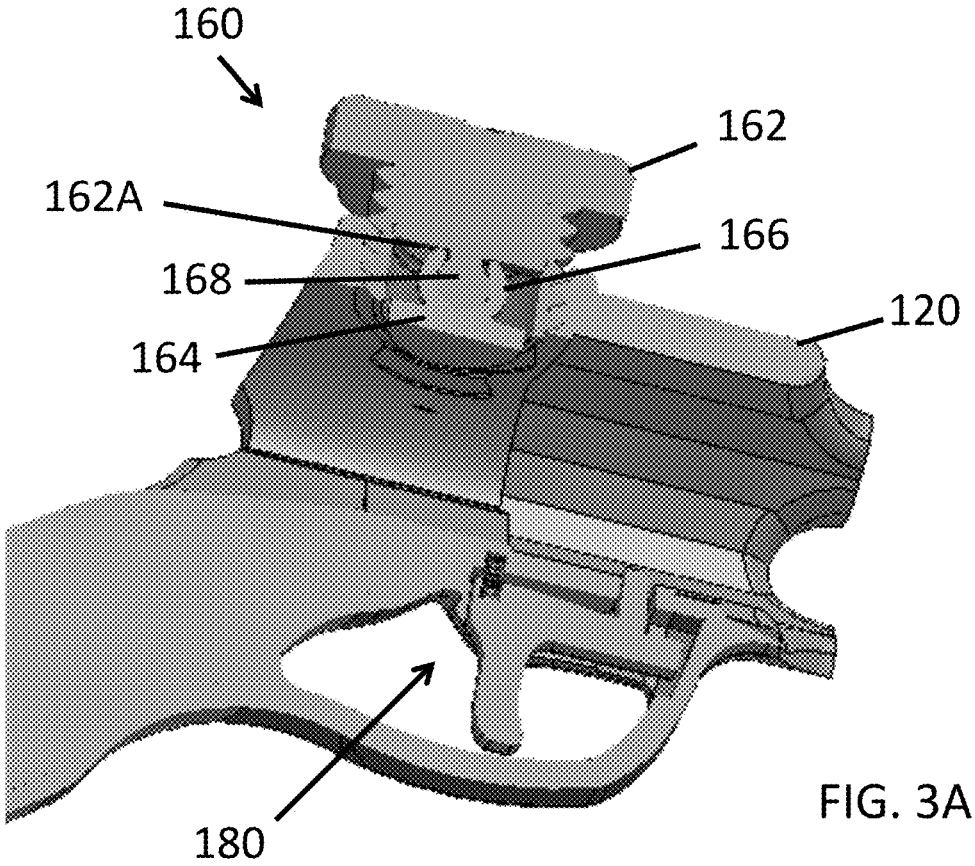
FIG. 3A illustrates a close-up cross-sectional view of an embodiment of a mechanism to secure the handle of the brush of FIG. 2A, with the mechanism in a retracted position.
Figure 3B:
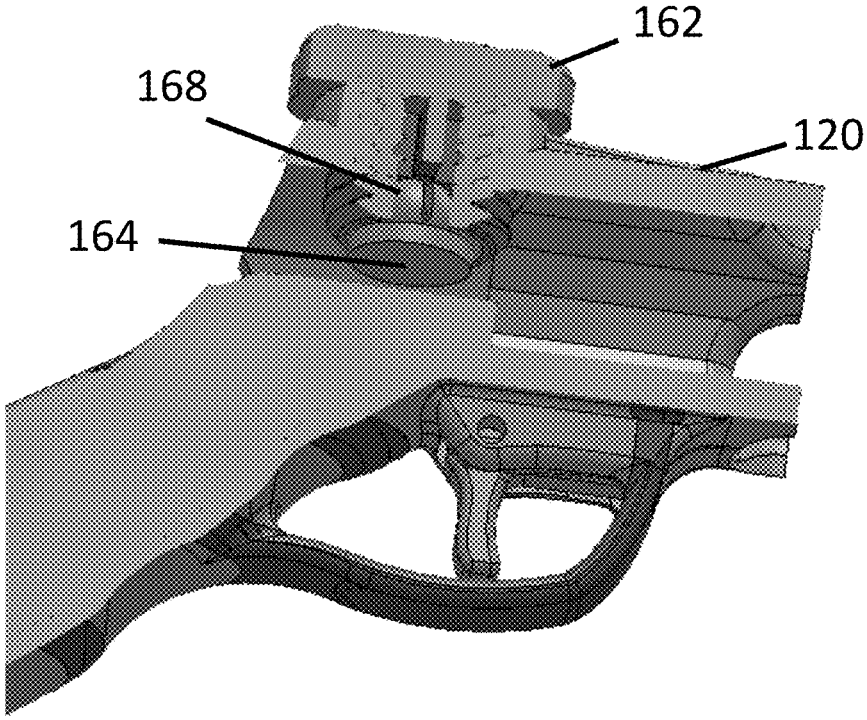
FIG. 3B illustrates a close-up cross-sectional view of the mechanism of FIG. 3A with the mechanism in an extended position.
Figure 3C:
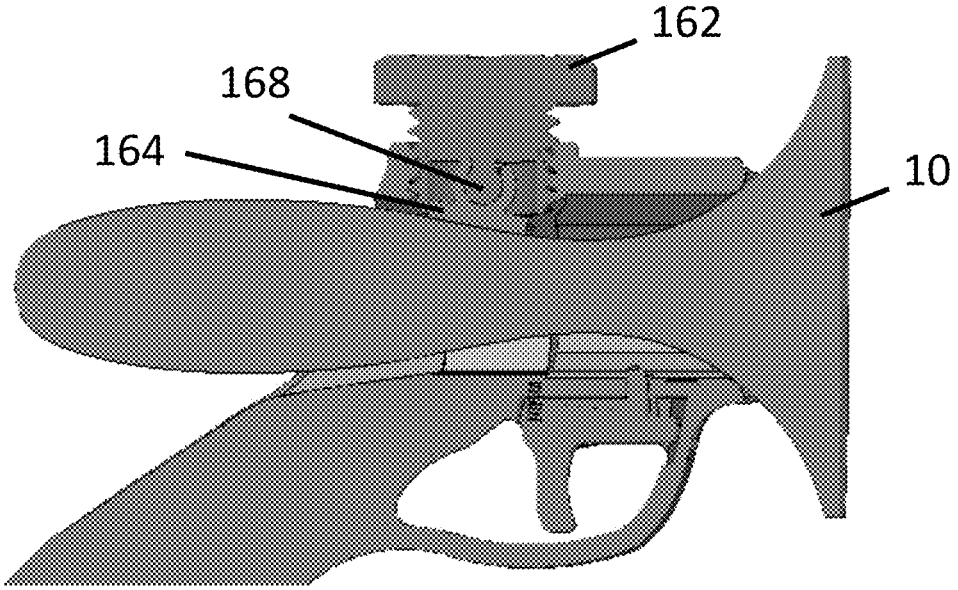
FIG. 3C illustrates a close-up cross-sectional view of the mechanism of FIG. 2A, with the mechanism in the extended position securing the handle of the brush of FIG. 2A.

To hold the brush handle 12 securely within the upper section 120, a first mechanism 160 may fit within a threaded opening 132 through the top of the rear 130 section (see, for example, FIG. 1B). In one embodiment, the first mechanism 160 may include a threaded cap or thumb screw 162 that screws into the opening 132. When the brush handle 12 is inserted into the upper section, the painter may turn the cap 162 until it tightens against the surface of the handle 12. To better accommodate angled or tapered surfaces of the handle 12, the first mechanism 160 may include, for example, a flat pressure plate or foot 164 secured to a hollow sphere 166 that captures a roller ball 168 and is secured to the bottom 162A of the cap 162 (FIG. 3A). As the cap 162 is screwed downwards (FIG. 3B) and the foot 164 contacts the surface of the brush handle 12, the sphere 166 rotates around the ball 168 and allows the foot 164 to "float" and conform to the angle of the surface of the brush handle 12 (FIG. 3C). Preferably, the foot 164 is formed from an elastomeric material, such as natural or synthetic rubber or other like material, to more securely hold the surface of the handle 12.

Referring back to FIG. 1D, in some embodiments, a support bed 134 may extend from opposite sides 134A, 134B of the interior of the rear section 130, separated by a U-shaped notch 136. The support bed 134 and notch 136 may support the bottom surface of the brush handle 12 when the handle 12 is secured by the first mechanism 160. The bed 134 and notch 136 surfaces are preferably coated with an elastomeric material, such as natural or synthetic rubber or the like, again to more securely hold the handle 12. Thus, the support bed 134 and notch 136 in cooperation with the first mechanism 160, are configured to securely hold paint brush handles of any style and shape.

Figure 4A:
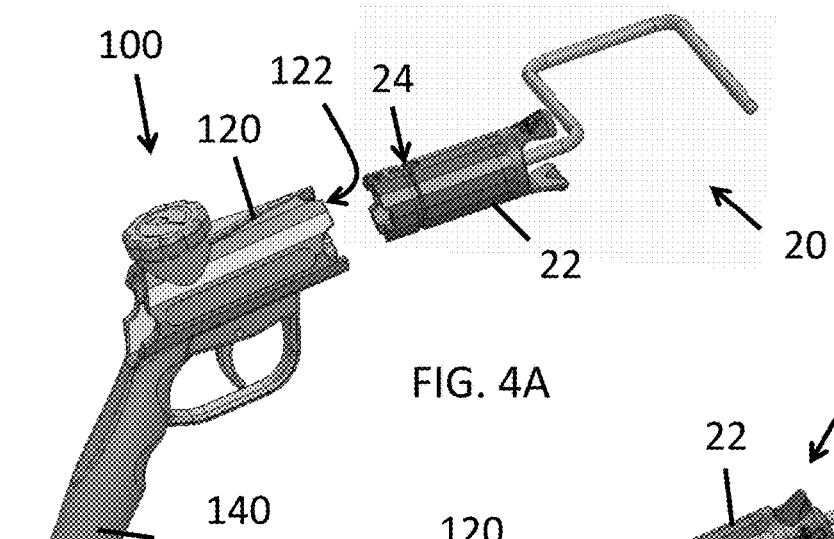
FIG. 4A illustrates a conventional roller frame before it is inserted into the coupler of FIG. 1A in a horizontal orientation.
Figure 4B:
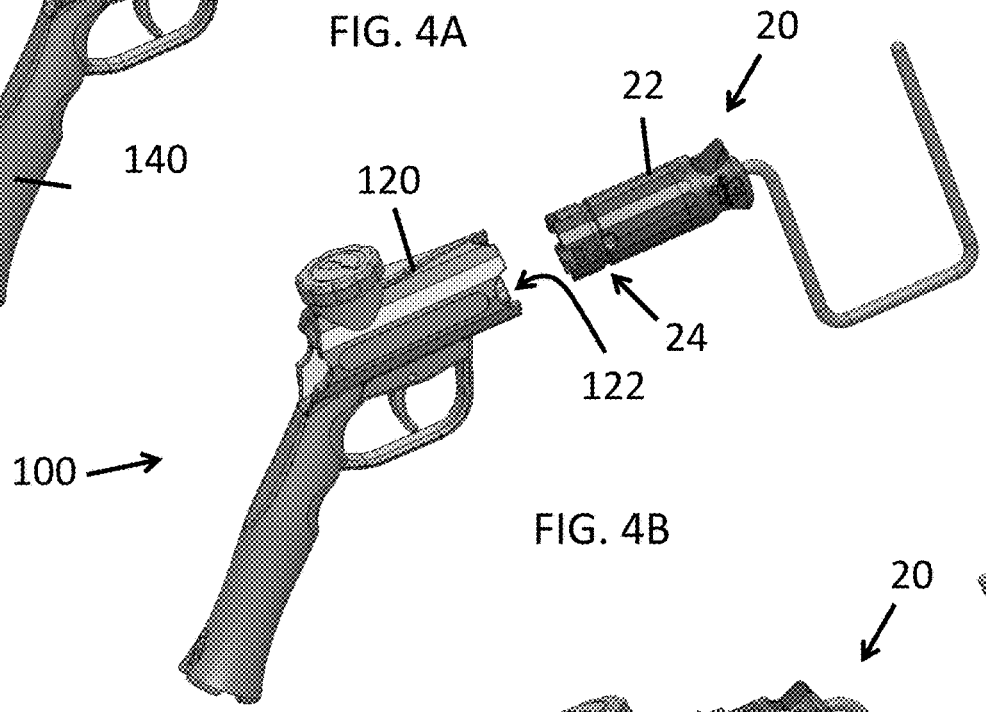
FIG. 4B illustrates the roller frame of FIG. 4A before it has been inserted into the coupler of FIG. 1A in a vertical orientation.
Figure 4C:
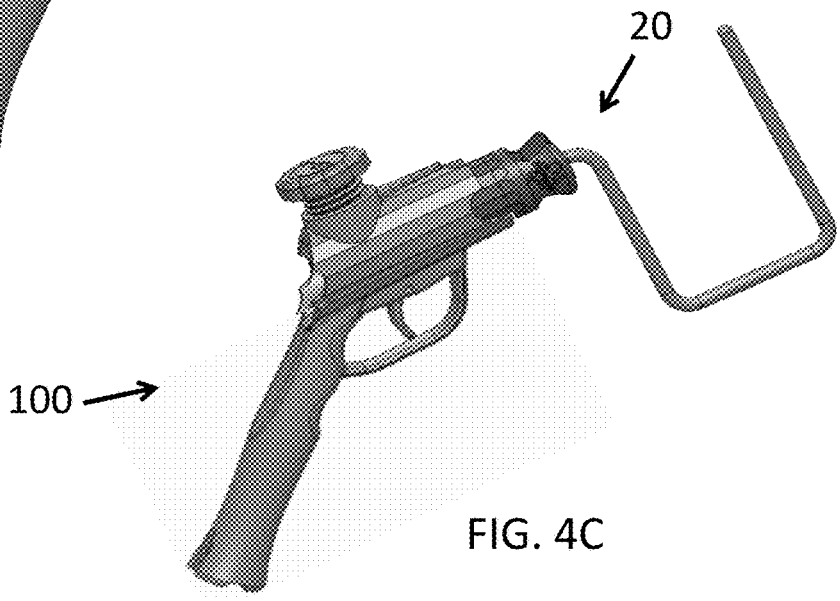
FIG. 4C illustrates the roller frame of FIG. 4A after it has been inserted into the coupler of FIG. 1A in a vertical orientation.

In some embodiments, the coupler 100 may also, or instead, be configured to hold the handle of a roller frame 20 (FIG. 4A). A roller handle may be inserted into the open front section 122 and secured with the first mechanism 160 in the same way as a brush handle. The inside wall of the front section 122, instead of being smooth, may be formed as a plurality of connected flat surfaces 126 surrounding the interior space and extending from the front edge 124 to the rear section 130. Such a configuration will allow the roller frame 20 with a multi-sided handle 22 to fit within the front section 122 in any of a number of positions. For example, when the handle 22 and the inside wall 126 have 16 sides or sections, the handle may be inserted in any of 16 radial positions approximately 22.5° apart, including horizontal (FIG. 4A) and vertical (FIGS. 4B, 4C).

Figure 5A:
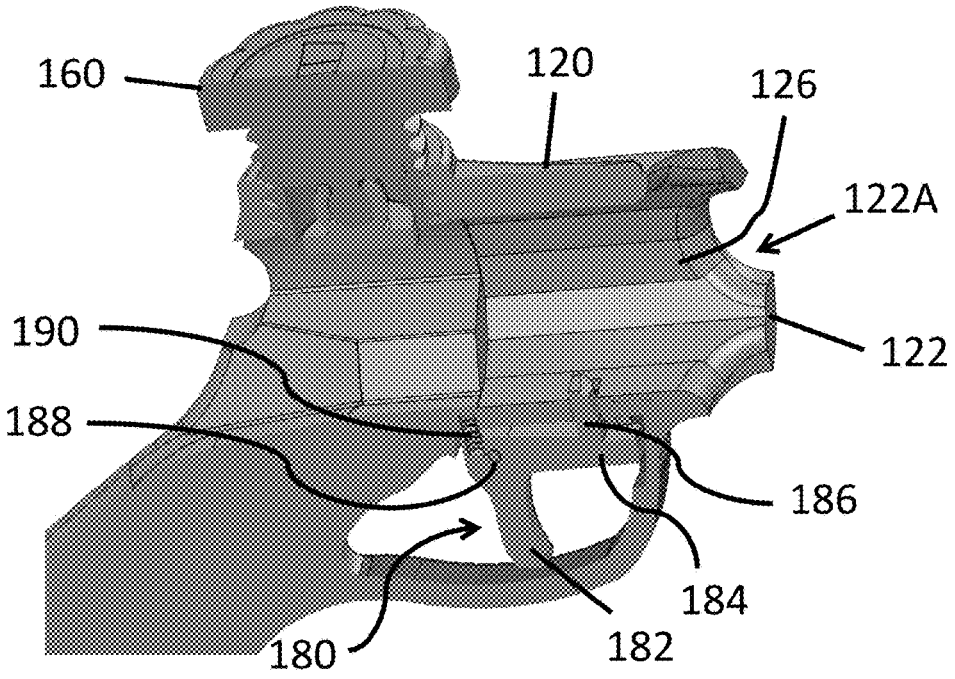
FIG. 5A illustrates the close-up cross-sectional view of an embodiment of a mechanism within the interior of the coupler of FIG. 1A to selectively hold and release the roller frame handle.
Figure 5B:
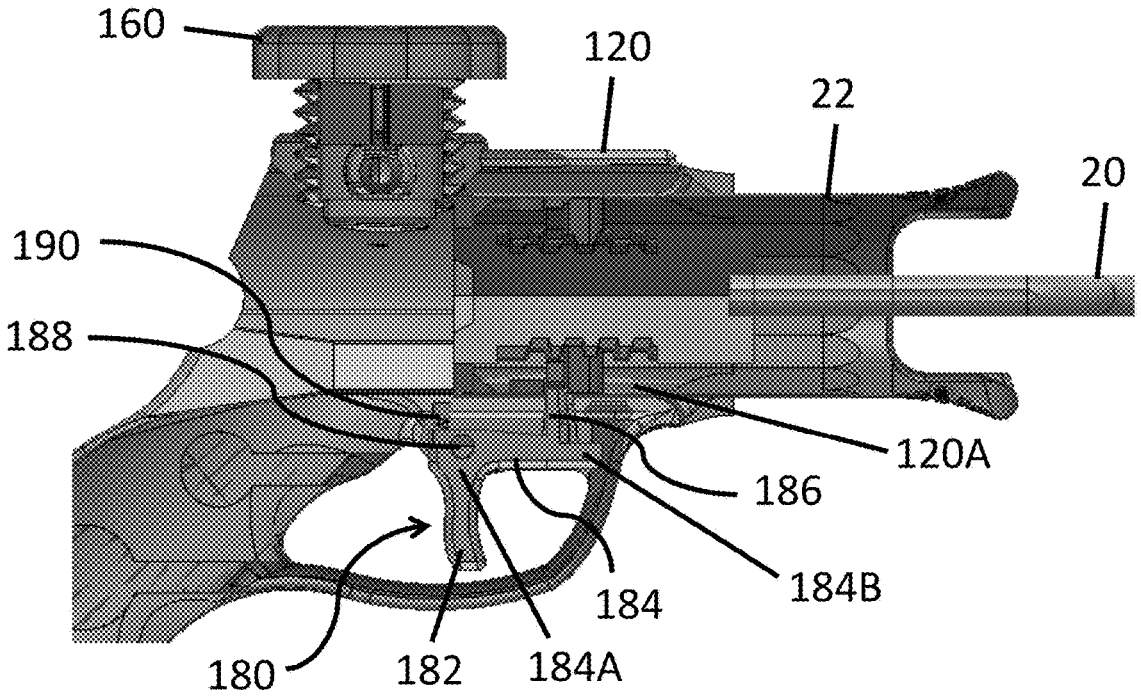
FIG. 5B illustrates a close-up cross-sectional view of the interior of a portion of the coupler of FIG. 1A with a roller frame handle secured within.

Furthermore, the coupler 100 may provide a second mechanism 180 to secure a roller handle 22 having a circumferential channel 24 formed around the perimeter, as shown in FIG. 4A. As illustrated in the cut-away side view of FIG. 5A, the second mechanism 180 includes a finger trigger 182, a front end 184B of a lever 184 attached to and extending forward from the top of the trigger 182, and a tab 186 attached to and extending upwards from the front end 184B of the lever 184 through the lower wall 120A of the front section 120. The trigger 182, lever 184, and tab 186 may be formed as a single component or may be formed as separate components and secured to each other. A pin 188 secures the rear end 184A of the lever 184 to the bottom of the front section 122 and allows the trigger/lever/tab 182/184/186 to pivot as a unit. A spring 190 extends from a small indentation in the bottom of the front section 122 into a similar small indentation in the top of the lever 184 behind the pivot pin 188. The spring is biased such that, in its "normal" state, it applies a force against the top of the lever 184 to cause the tab 186 at the front of the lever to protrude into the interior space of the front section (FIG. 5A). When a roller handle 22 is inserted into the front section 122 and pushes against front of the tab 186, the tab 186 and front of the lever 184 are pushed downwards against the bias of the spring 190. When handle 22 is pushed in far enough, the channel 24 is adjacent the tab 186 and the spring 190 forces the tab 186 into the channel 24, locking the handle 22 in place (FIG. 5B). To release the handle 22, the painter pulls the trigger 182 towards the rear of the coupler 100 against the bias of the spring 190. The tab 186 is pulled out of the channel 24 and the handle 22 may be removed from the coupler 100. Preferably, the front edge of the tab 186, or the back edge of the roller handle 22, or both, has a beveled surface to aid the movement of the tab 186 by the handle 22.

Figure 6:
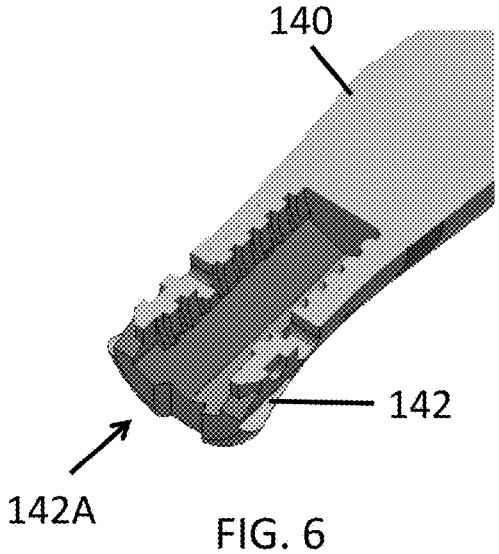
FIG. 6 illustrates a close-up cross-sectional view of the lower portion of the coupler of FIG. 1A.
Figure 7A:
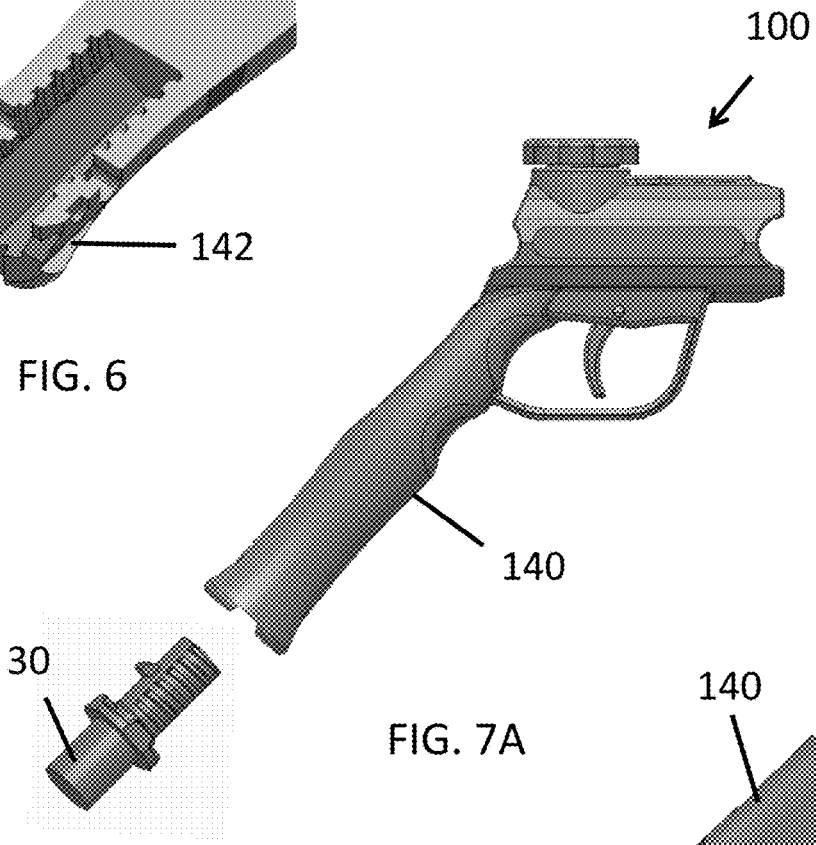
FIG. 7A illustrates one type of pole end before being secured to the coupler of FIG. 1A.
Figure 7B:
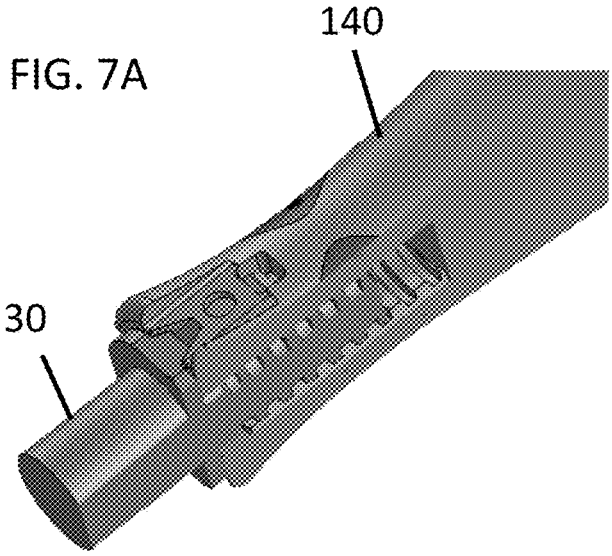
FIG. 7B illustrates a close-up cross-sectional view of the pole end of FIG. 7A after being secured to the coupler of FIG. 1A.
Figure 8A:
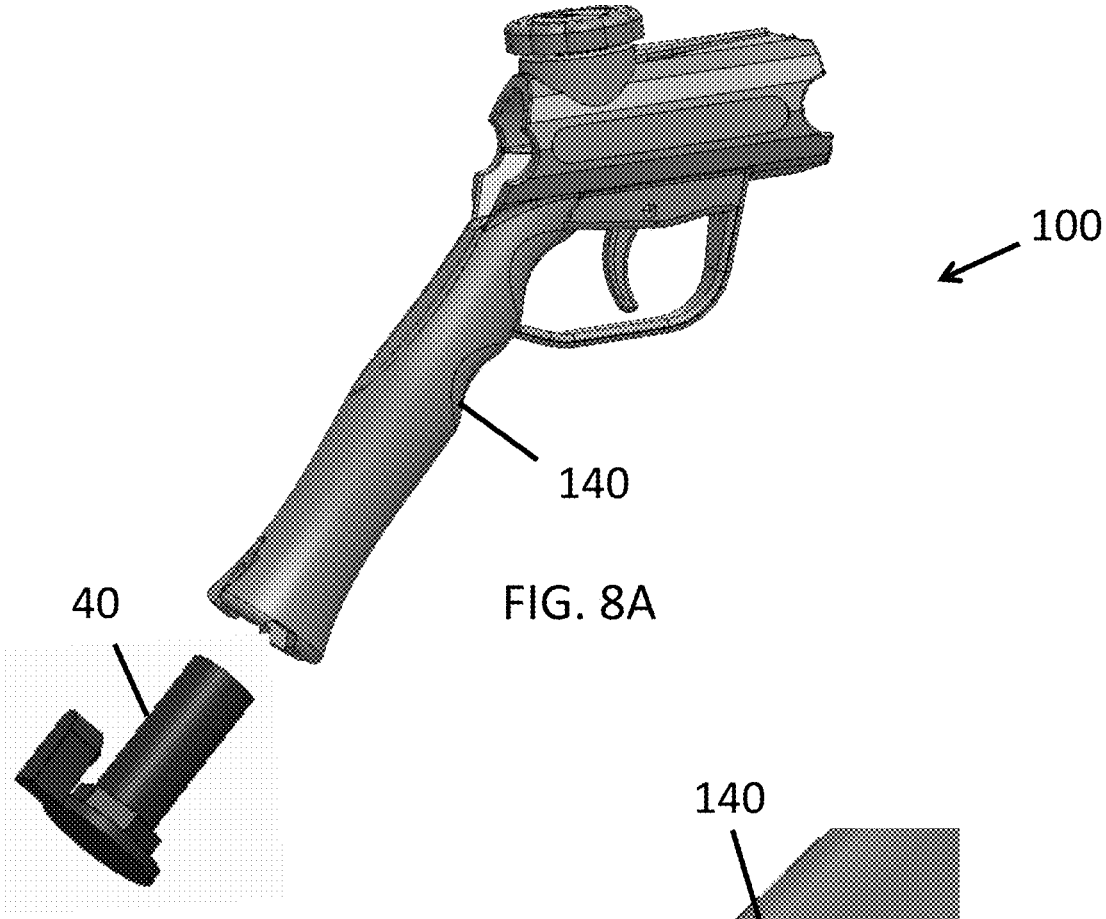
FIG. 8A illustrates a second type of pole end before being secured to the coupler of FIG. 1A.
Figure 8B:
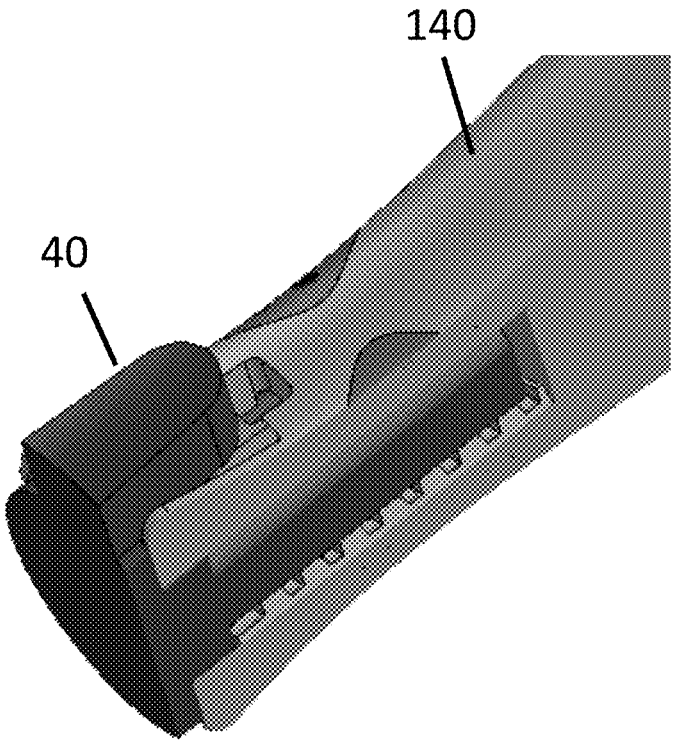
FIG. 8B illustrates a close-up cross-sectional view of the pole end of FIG. 8A after being secured to the coupler of FIG. 1A

In embodiments of the coupler 100, the open bottom end 142 of the angled cylindrical section 140 may be attachable onto one or more extension poles. For example, as illustrated in the cut-away view of FIG. 6, the interior 142A of the end 142 may be threaded to receive the threaded end of conventional extension poles, which are available in a variety or fixed and telescoping lengths. The end 142 may also be configured to receive and secure a Power Lock® extension pole with a coupler 30 manufactured by Purdy® Corporation (FIGS. 7A, 7B). The end 142 may also be configured to receive and secure a pole with a Sherlock® type coupler 40 manufactured by The Wooster Brush Company (FIGS. 8A, 8B). It will be appreciated that the end 142 of the coupler 100 may be configured to accommodate any one, two, or all three pole end types, as well as others.

Figure 9A:
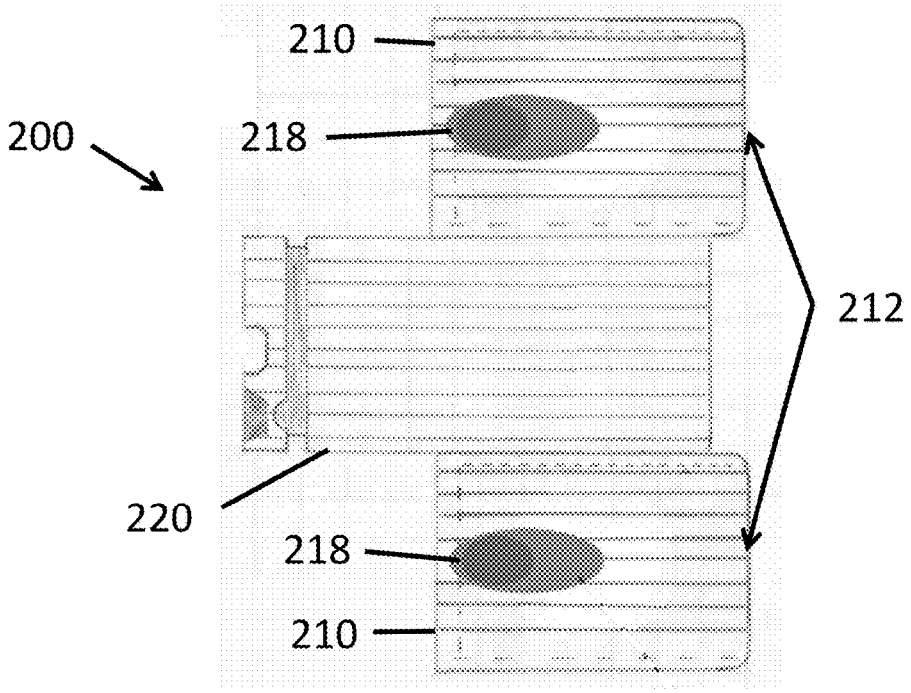
FIG. 9A illustrates a top view of an embodiment of another roller coupler of the present invention.
Figure 9B:
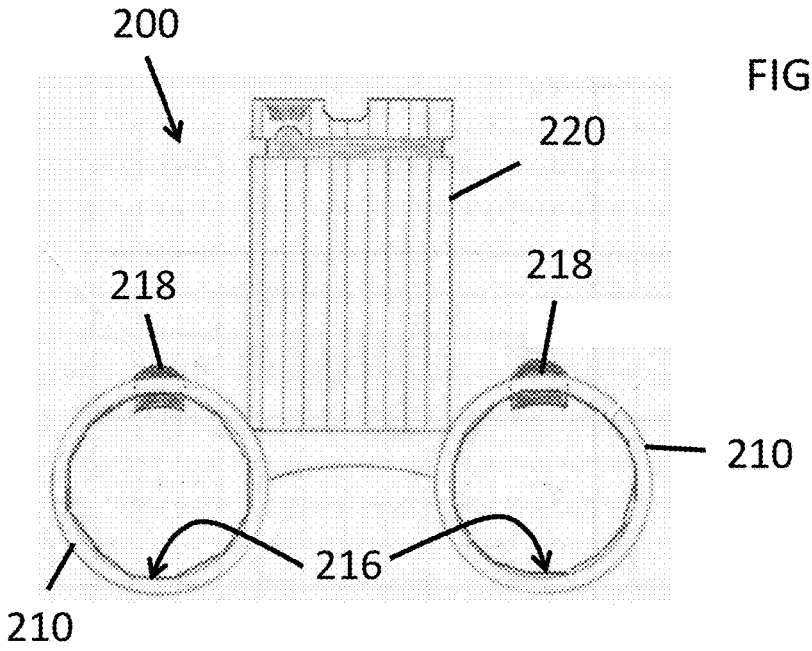
FIG. 9B illustrates a front view of the roller coupler of FIG. 9A.
Figure 9C:
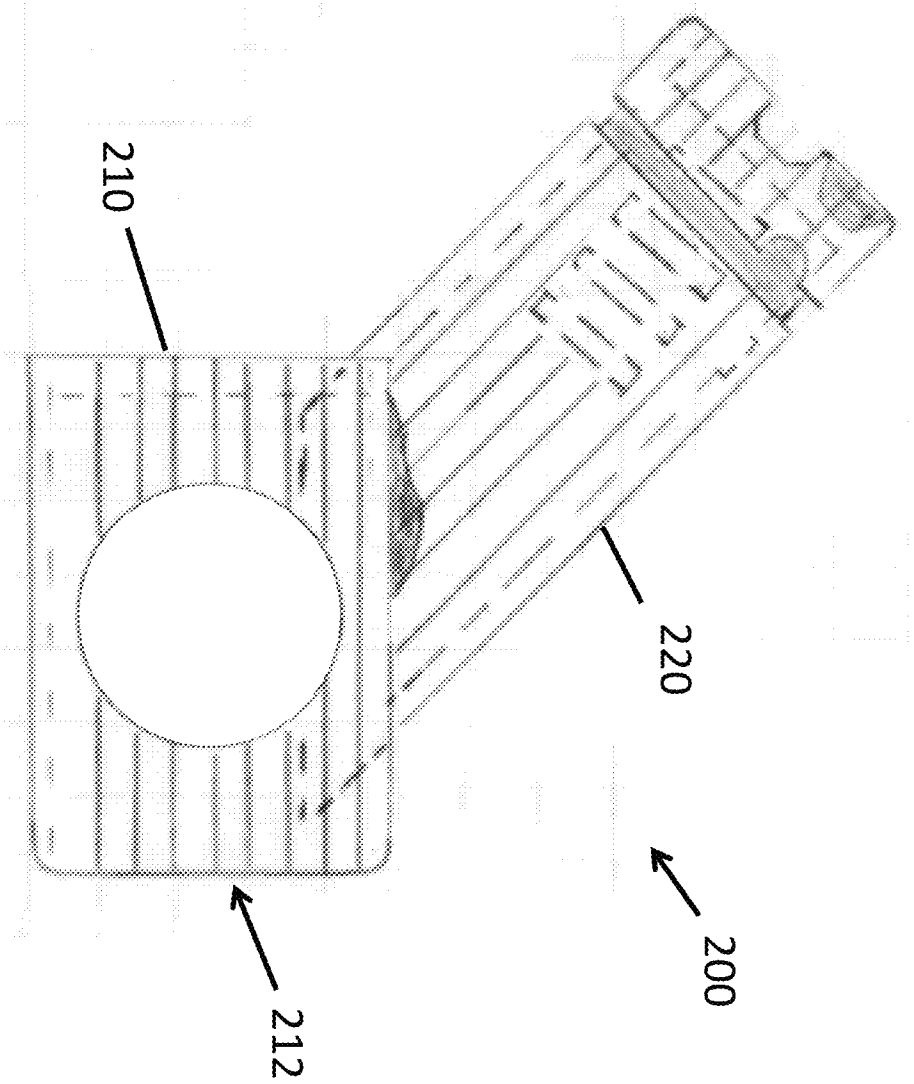
FIG. 9C illustrates a side view of the roller coupler of FIG. 9A.

FIGS. 9A, 9B, and 9C illustrate top, side, and front views, respectively, of another embodiment of a coupler 200 of the present invention useful for painting pipes. The coupler 200 includes a pair of horizontal tubular side sections 210 and a central cylindrical section 220 extending upward at an angle, such as about 45°, from the side sections 210. The side sections 210 have an open front 212 and multi-sided interior walls 216 (best seen in FIG. 9B). The cylindrical section 220 may include an open top end 222. It will be appreciated that the exact angle of the cylindrical section 220 relative to the side sections 210 is not critical. An angle of approximately 45° provides an ergonomic gripping position for the painter but other angles may also be used.

The open front 212 of both side sections 210 of the coupler 200 is configured to receive the handle 22 of a roller 20. Each side section 210 also includes a spring-loaded latching mechanism 218 configured to mate with a groove 24 around the handle 22 and securely retain the handle 22 in the side section 210. The mechanism 218 also allows the painter to release the roller handle 22.

Figure 9D:
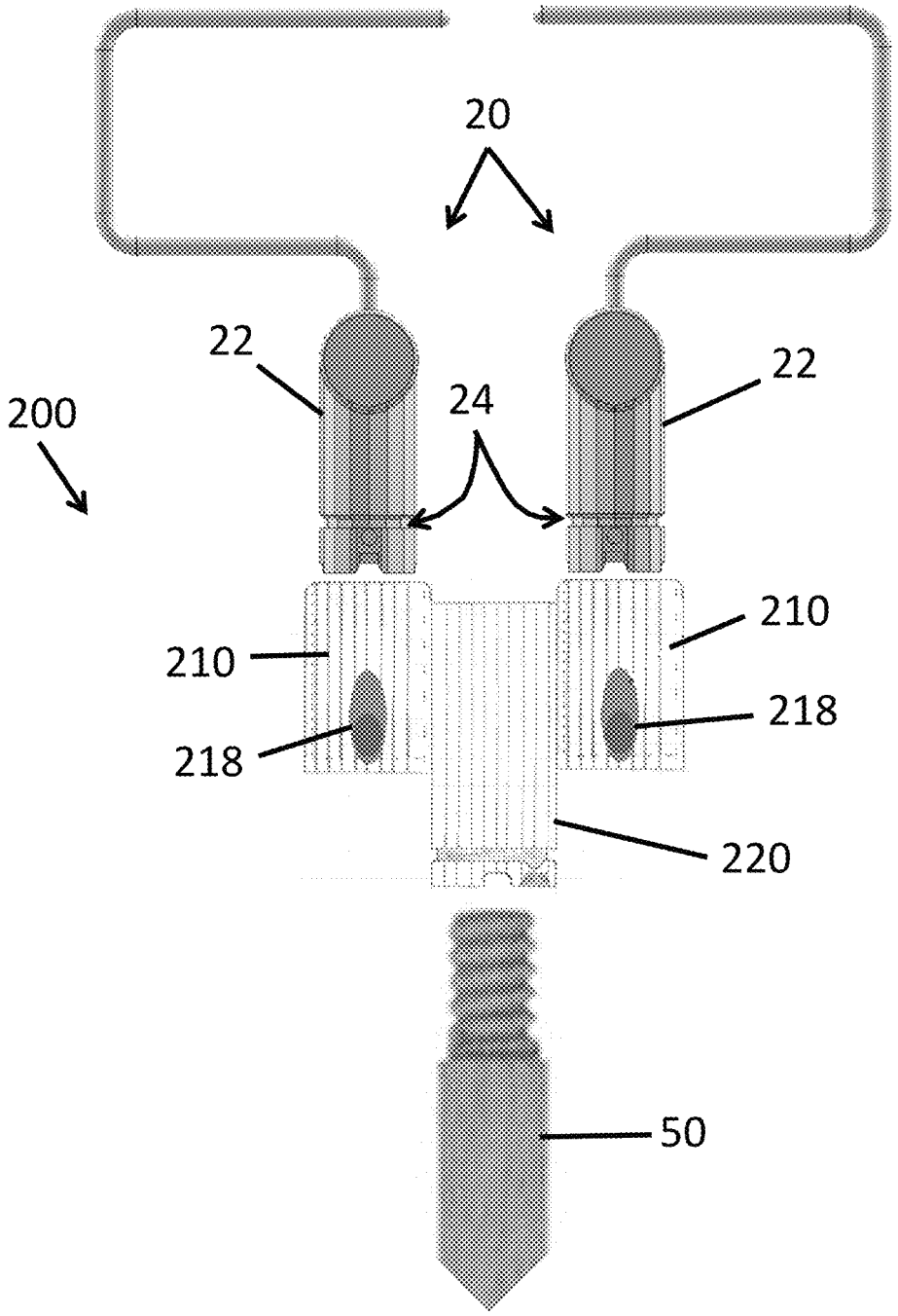
FIG. 9D illustrates a top view of the roller coupler of FIG. 9A with two rollers and an extension handle.

The central section 220 is configured in the same way as the cylindrical section 140 of the coupler 100 described above and is configured to be attachable to one or more types of extension poles. Such poles may include, for example, a conventional threaded end 50 (FIG. 9D), a Power Lock® extension pole with a coupler 30 manufactured by Purdy® Corporation, and a Sherlock® type coupler 40 manufactured by The Wooster Brush Company. It will be appreciated that the section 220 of the coupler 200 may be configured to accommodate any one, two, or all three pole end types, as well as others.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A paint brush and roller handle coupler, comprising:

a horizontal tubular upper section, comprising:

an open front section, comprising a front edge having a first pair of notches spaced 180 degrees apart; and an open rear section;

a cylindrical section extending downward at an angle from the upper section, the cylindrical section having an open lower end with a threaded interior wall;

a first mechanism configured to secure a paint brush handle, inserted through the open front section and extending through the open rear section, within the tubular upper section; and a second mechanism configured to secure a paint roller handle, inserted through the open front section, within the tubular upper section.

2. The coupler of claim 1, wherein the front edge of the open front section comprises a second pair of notches spaced 180 degrees apart from each other and spaced 90 degrees apart from the first pair of notches, whereby the paint brush handle or the roller handle is securable within the horizontal tubular upper section in either a horizontal orientation or a vertical orientation.

3. The coupler of claim 1, wherein:

the open rear section of the horizontal tubular upper section, comprises a support bed having first and second surfaces along opposite sides of an interior wall of the open rear section and extending rearward from the of the open front section, the first and second surfaces separated by a U-shaped notch; and the support bed and U-shaped notch are configured to support a handle of a paint brush.

4. The coupler of claim 1, wherein the first mechanism comprises a threaded knob configured to screw into and out of a threaded opening in a top of the upper section, whereby a lower end of the threaded knob presses against the brush handle when the threaded knob is in a lowered position and releases the brush handle when the threaded knob is in a raised position.

5. The coupler of claim 4, wherein the first mechanism further comprises a flat plate pivotably secured to the lower end of the threaded knob and whereby, when the threaded knob is in the lowered position, the flat plate conforms to an angle of the brush handle.

6. The coupler of claim 5, wherein the flat plate comprises an elastomeric material.

7. The coupler of claim 5, whereby the flat plate is pivotally secured to the lower end of the threaded knob with a ball and socket.

8. The coupler of claim 1, wherein the second mechanism comprises:

a horizontal lever pivotably connected to a bottom of the tubular upper section;

a trigger extending downward from a first end of the horizontal lever;

a tab extending upward from a second end of the horizontal lever and protruding through a bottom wall of the tubular upper section; and a spring biased to maintain the tab in a first position, retaining the roller handle within the tubular upper section;

whereby, when the trigger is pulled against the bias of the spring in a direction towards the open rear section of the tubular upper section, the tab is pulled downward from the bottom wall into a second, retracted position, disengaging the tab from the roller handle and releasing the roller handle from the tubular upper section.

9. The coupler of claim 1, wherein the open front section of the horizontal tubular upper section comprises a plurality of connected flat surfaces surrounding an interior space of the open front section extending rearward from the front edge.

10. The coupler of claim 9, wherein the plurality of connected flat surfaces comprises 16 connected flat surfaces.

11. The coupler of claim 1, wherein the open lower end of the cylindrical section is configured to releasably retain a pole with a coupler having a hexagonal base and a spring-loaded tab on an end.

12. The coupler of claim 1, wherein the open lower end of the cylindrical section is configured to releasably retain a pole with a coupler having four tabs extending from a base and a spring-loaded tab on an end.

13. The coupler of claim 1, wherein the open lower end of the cylindrical section is configured to releasably retain pole with a threaded end.

* * * * *